US007568919B2

(12) United States Patent
Hoshino et al.

(10) Patent No.: US 7,568,919 B2
(45) Date of Patent: Aug. 4, 2009

(54) CONNECTOR FOR CONNECTING PRINTED BOARDS HAVING A PLUG HAVING PRESS-IN GROOVES FITTED INTO A SOCKET

(75) Inventors: Hirokazu Hoshino, Tokorozawa (JP); Naoyuki Kimura, Fuchu (JP); Yusuke Shimura, Kawasaki (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 11/862,067

(22) Filed: Sep. 26, 2007

(65) Prior Publication Data

US 2008/0081503 A1 Apr. 3, 2008

(30) Foreign Application Priority Data

Sep. 29, 2006 (JP) ..... 2006-266280

(51) Int. Cl.
*H01R 12/00* (2006.01)

(52) U.S. Cl. ..... 439/74

(58) Field of Classification Search ..... 439/74, 439/284, 285, 660, 296, 246, 248, 81
See application file for complete search history.

(56) References Cited

U.S. PATENT DOCUMENTS 5,695,353 A * 12/1997 Sakata et al. ..... 439/326
5,975,916 A * 11/1999 Okura ..... 439/74
6,623,308 B2 * 9/2003 Ono ..... 439/680
6,764,314 B1 * 7/2004 Lee ..... 439/65
7,059,908 B2 * 6/2006 Yamaguchi ..... 439/609
7,344,387 B2 * 3/2008 Shiroyama ..... 439/74
7,367,816 B2 * 5/2008 Liu ..... 439/74

FOREIGN PATENT DOCUMENTS

CN 2745233 Y 12/2005
JP 2005-203139 A 7/2005
KR 10-0538161 12/2005

OTHER PUBLICATIONS

Chinese Office Action for Application No. 2007101416194, dated Sep. 5, 2008, and English translation thereof, 14 pages.
Korean Office Action for Application No. 10-2007-0072037, dated Sep. 25, 2008, and English translation thereof, 14 pages.
English abstract of JP2005203139 published Jul. 28, 2005, esp@cenet database, 1 page.

* cited by examiner

*Primary Examiner*—Chandrika Prasad
(74) *Attorney, Agent, or Firm*—Osha • Liang LLP

(57) ABSTRACT

A connector includes a socket in which a plurality of first splices are provided in parallel in an opening edge portion and a plug which has a flat shape. The plug is capable of being fitted in the opening edge portion of the socket. The plug includes a plurality of second splices press-fitted in press-in grooves provided in parallel at positions corresponding to the first splices in the plug. Each of the first splices is fitted and abuts on an inside surface of one of the press-in grooves. Each of the first splices is brought into elastic contact wit one of the second splices to establish electrical connection.

4 Claims, 14 Drawing Sheets

(A)

(B)

(A)

(B)

Fig6. A
(A)
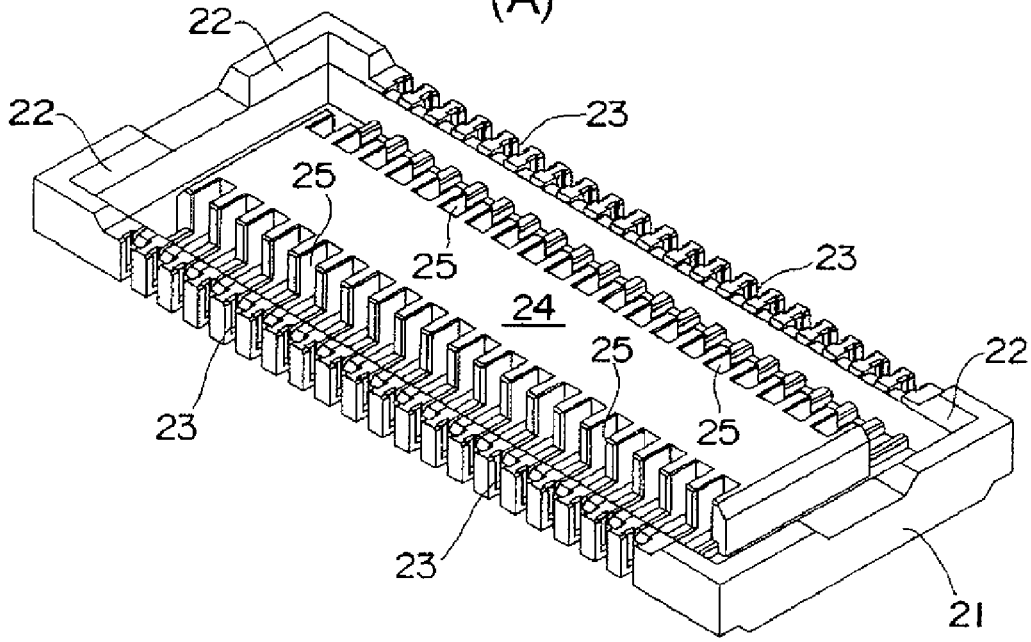
(B)
Fig6. B
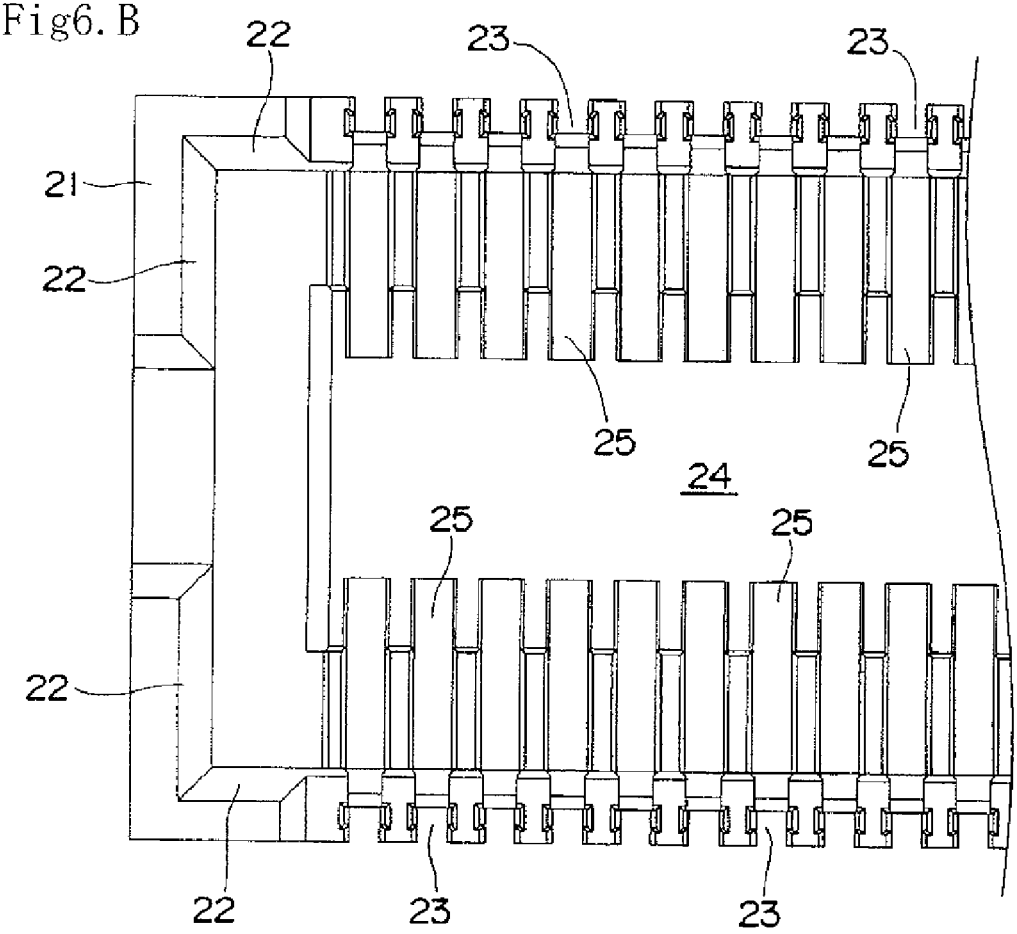

(A)

(B)

(C)

(D)

(A)

(B)

(C)

(D)

(A)

(B)

(A)

(B)

(A)

(B)

CONNECTOR FOR CONNECTING PRINTED BOARDS HAVING A PLUG HAVING PRESS-IN GROOVES FITTED INTO A SOCKET

BACKGROUND OF THE INVENTION

1. Field of the Invention

The present invention relates to a connector, particularly to a connector for electrically connecting printed boards to each other.

2. Description of the Related Art

Conventionally, in a connector which connects printed boards to each other, a socket 11 fixedly connected to an upper surface of a circuit board A is fitted in a header 12 fixedly connected to a lower surface of another printed board A, and a contact terminal 14 provided in the socket 11 and a contact terminal 16 provided in the header 12 are connected to each other while being in elastic contact with each other (refer to, for example, Japanese Patent Application Laid-Open No. 2005-203139).

However, in the conventional connector, when the header 12 is positioned and fitted in the socket 11, the connector is not visible because the connector is hidden behind the upper printed board. Therefore, the positioning is not easily performed in the fitting work. When the header is forcedly connected to the socket while inaccurately positioned, there arises a problem that contact resistance is increased and contact reliability is thus lowered.

SUMMARY OF THE INVENTION

In view of the foregoing, an object of the present invention is to provide a connector with high contact reliability even if component accuracy or assembly accuracy varies.

A connector according to an aspect of the present invention includes a socket in which a plurality of first splices are provided in parallel in an opening edge portion; and a plug which has a flat shape capable of being fitted in the opening edge portion of the socket, second splices being press-fitted in press-in grooves provided in parallel at positions corresponding to the first splices in the plug, wherein the first splice is fitted while being able to abut on an inside surface of the press-in groove, and the first splice is brought into elastic contact with the second splice to establish electrical connection.

According to the aspect of the present invention, the first splice is fitted in the press-in groove of the plug, and the first splice is brought into elastic contact with the second splice which is press-fitted and retained in the press-in groove, whereby the electrical connection is established between the first splice and the second splice. Therefore, even if the component accuracy and assembly accuracy vary, the first splice whose position is regulated in the press-in groove is correctly brought into elastic contact with the second splice. Accordingly, the connector with high contact reliability with which the contact failure hardly occurs is obtained.

In the connector according to the aspect of the present invention, a first contact portion is preferably fitted while being able to abut on the inside surface of the press-in groove of the plug, and the first contact portion is brought into elastic contact with the second splice to establish the electrical connection, the first contact portion being formed to stride over the opening edge portion of the socket, the first contact portion being provided at a corner portion inside a press-in portion of the first splice press-fitted and retained in the opening edge portion. Therefore, even if the component accuracy and assembly accuracy vary, the first splice whose position is regulated in the press-in groove is correctly brought into elastic contact with the second splice. Accordingly, the connector with high contact reliability with which the contact failure hardly occurs is obtained.

In the connector according to the aspect of the present invention, a second contact portion provided in a free end portion of the first splice is preferably brought into elastic contact with a rear surface of a U-shaped press-in portion of the second splice press-fitted in the press-in groove of the plug. Therefore, the second contact portion of the first splice is brought into elastic contact with the rear surface of the U-shaped press-in portion of the second splice, so that not only the second contact portion of the first splice is brought into elastic contact with the U-shaped press-in portion of the second splice, but also the first contact portion of the first splice is more surely brought into elastic contact with the second splice. Accordingly, the contact reliability is further improved between the first splice and the second splice.

In the connector according to the aspect of the present invention, retaining protrusions are preferably provided on both outside surfaces of the U-shaped press-in portion of the second splice, the retaining protrusions being latched onto at least one of the first contact portion and the second contact portion, the second splice being press-fitted between the first contact portion and the second contact portion in the first splice, the first contact portion and the second contact portion facing each other. Therefore, when the first splice is brought into elastic contact with the second splice, the first splice and the second splice are brought into elastic contact with each other while overriding the retaining protrusion. Accordingly, there is an advantage that click feeling is obtained which gives a sense of reassurance to a worker while the coming off can be prevented.

BRIEF DESCRIPTION OF THE DRAWINGS

FIGS. 6A and 6B show a perspective view and a partially enlarged plan view of a socket body shown in FIG. 5;

FIG. 7A shows a perspective view, FIG. 7B shows a perspective view when viewed from a different angle, FIG. 7C shows a plan view, and FIG. 7D shows a front view, respectively;

FIG. 8A shows a perspective view, FIG. 8B shows a perspective view when viewed from a different angle, FIG. 8C shows a plan view, and FIG. 8D shows a front view, respectively;

DETAILED DESCRIPTION OF THE PREFERRED EMBODIMENTS

Figure 1A:
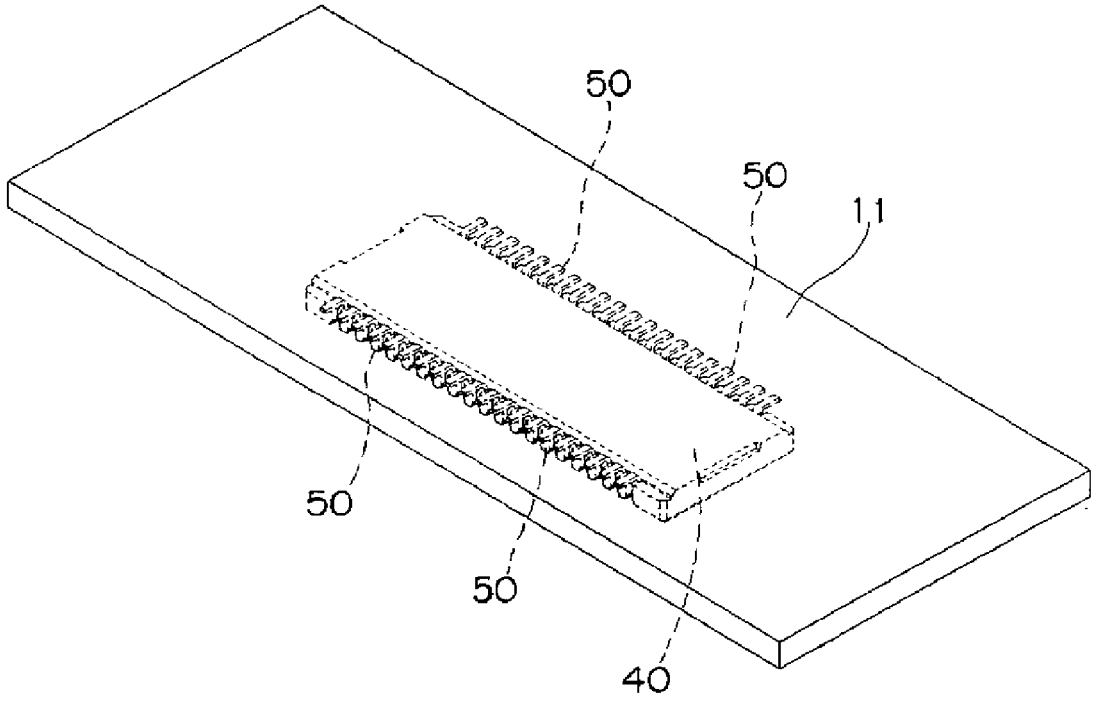
FIGS. 1A and 1B show perspective views of a plug and a socket in use of a connector according to an embodiment of the present invention.
Figure 1B:
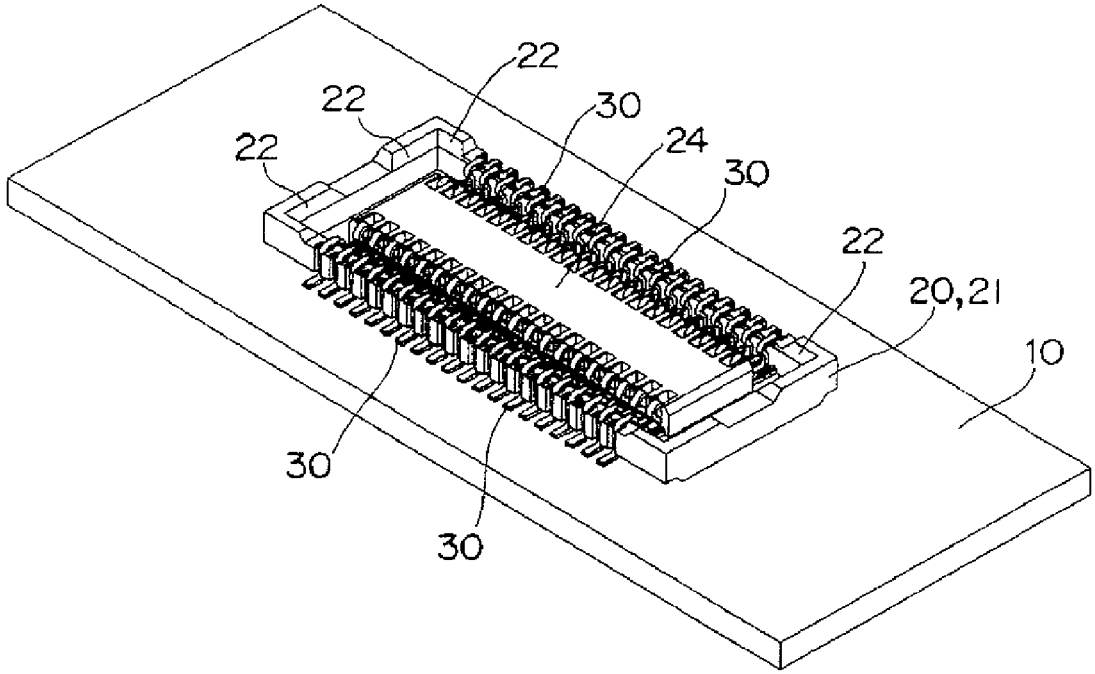
Figure 2A:
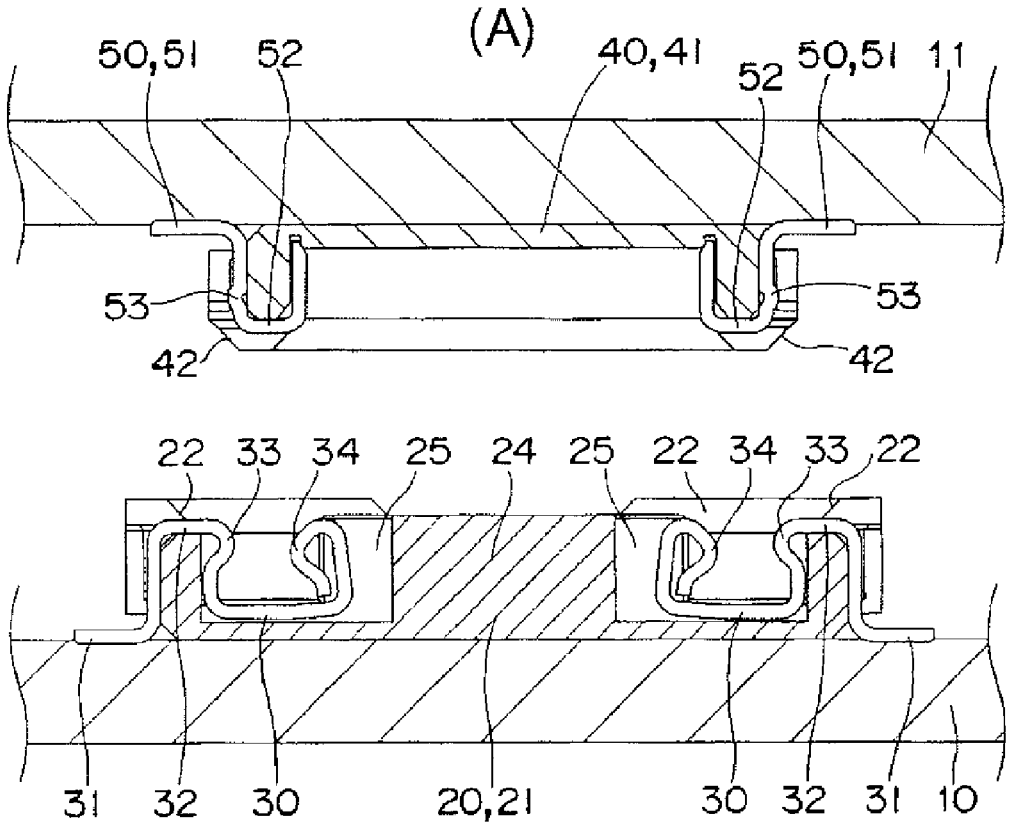
FIGS. 2A and 2B show cross-sectional views illustrating a method of connecting the plug and the socket of the connector according to the embodiment.
Figure 2B:
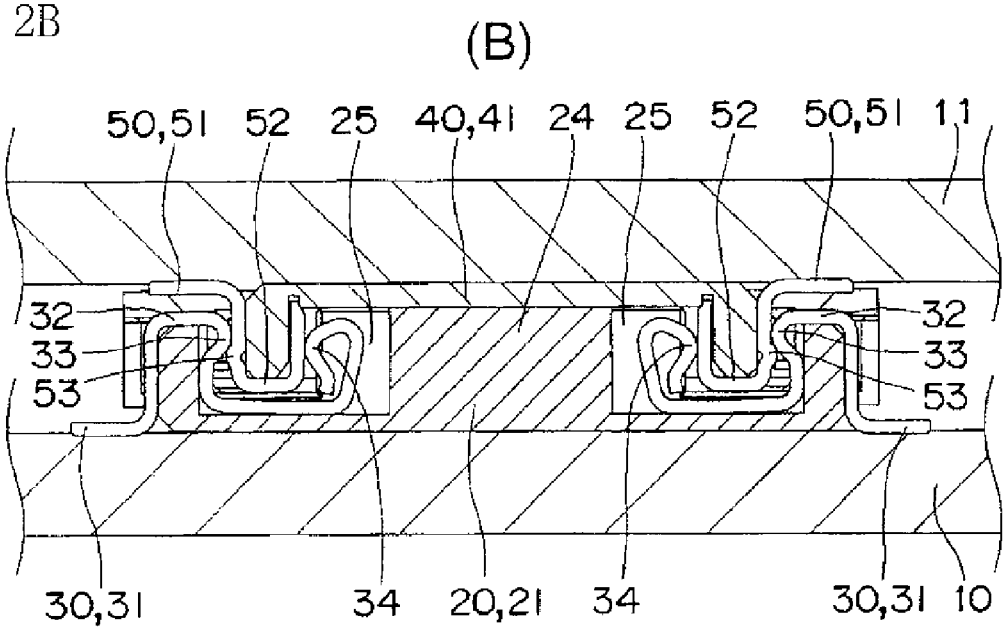
Figure 3A:
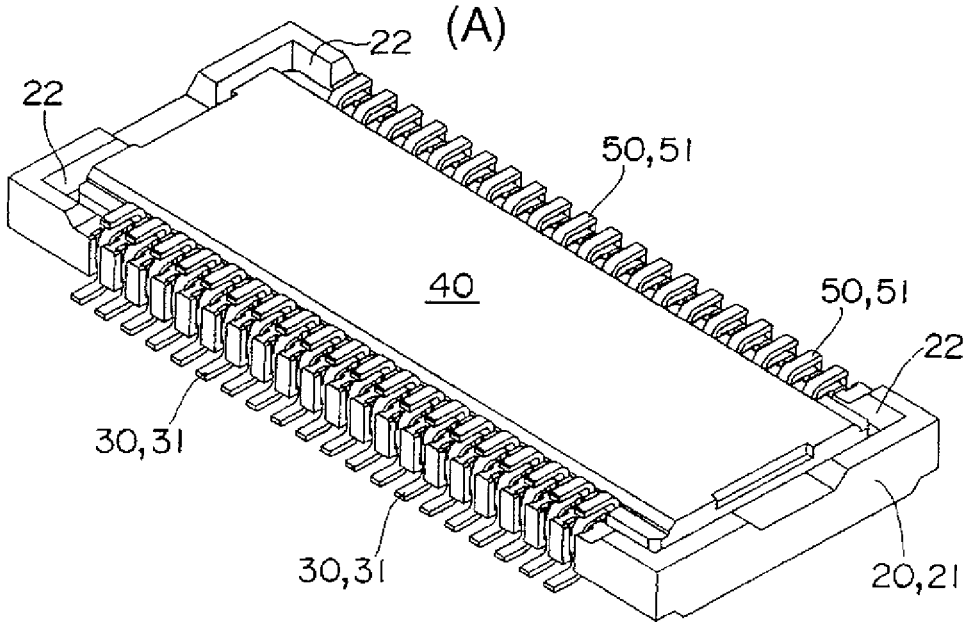
FIGS. 3A and 3B show a perspective view and a partially enlarged plan view of the connector according to the embodiment.
Figure 3B:
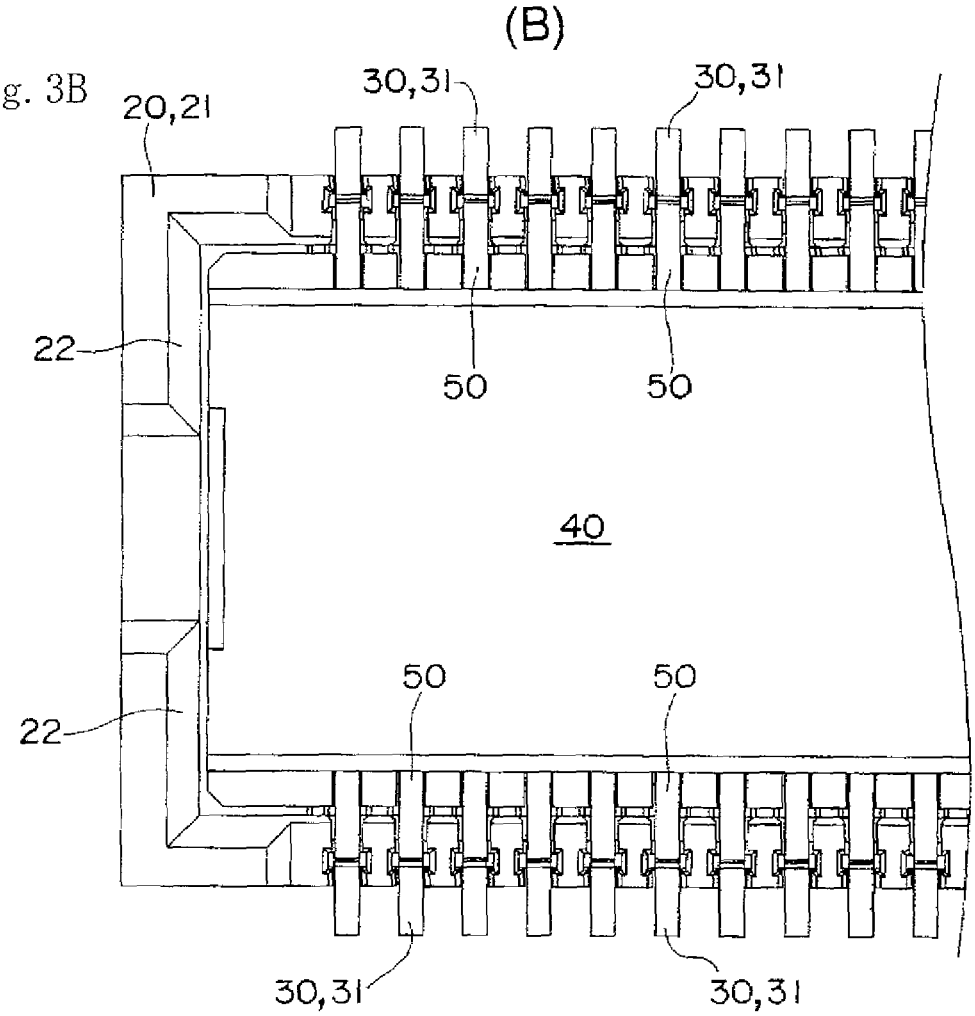
Figure 4A:
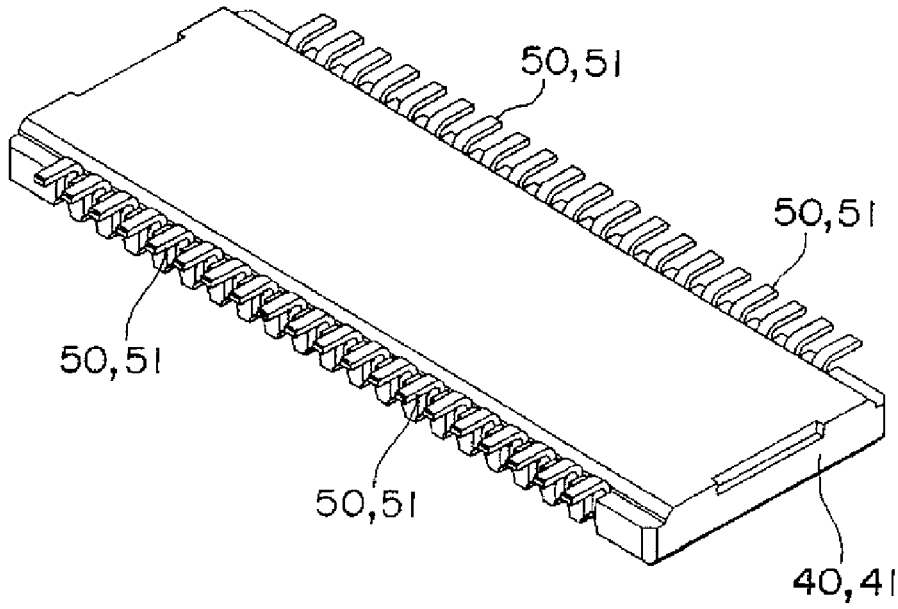
FIG. 4 shows an exploded perspective view of the plug and the socket of the connector shown in FIG. 3.
Figure 4B:
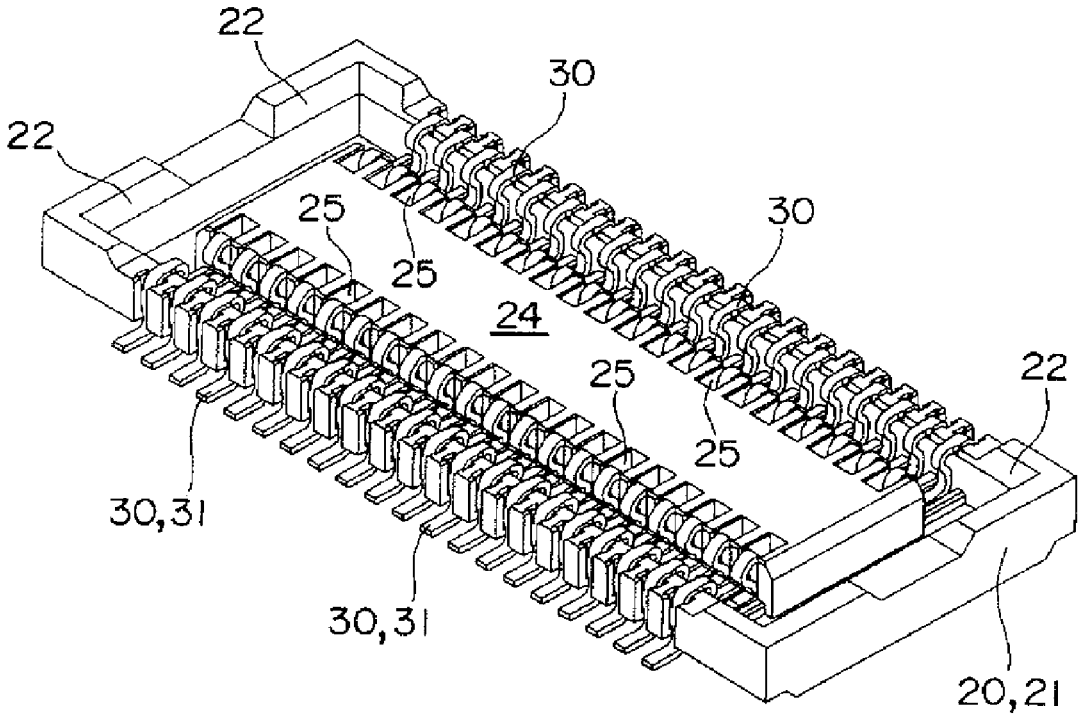

Preferred embodiments of a connector according to the present invention will be described with reference to the accompanying drawings. As shown in FIGS. 1 and 2, the connector according to the present embodiment includes a socket 20 and a plug 40. The socket 20 is connected to an upper surface of a printed wiring board 10, and the plug 40 is connected to a lower surface of a printed wiring board 11.

In the socket 20, a plurality of first splices 30 are provided in parallel along opening edge portions located on opposite sides of a socket body 21. As shown in FIG. 6, the socket body 21 has a box shape with a shallow bottom, a guiding tapered surface 22 is formed in the opening edge portion of the socket body 21, and press-in grooves 23 are provided in parallel at a predetermined pitch along outside surfaces of sidewalls located on opposite sides. The first splices 30 to be described later are press-fitted in the press-in grooves 23. In the socket body 21, a base portion 24 having a flat rectangular shape is projected at the center of a bottom surface, and fitting grooves 25 are provided in parallel at positions corresponding to the press-in grooves 23 on the outer peripheral surfaces of the base portion 24. The fitting groove 25 is wider than a second contact portion 34, which will be described later, located in a free end portion of the first splice 30. Obviously, the guiding tapered surface 22 may be formed in an R-surface.

As shown in FIG. 7, in the first splice 30, a portion extended from a wire connection portion 31 is vertically bent to form a substantially U-shaped press-in portion 32, and a first contact portion 33 is formed at a corner portion on the free end side of the press-in portion 32. A free end portion extended from the press-in portion 32 is vertically bent and curved to form the second contact portion 34. The second contact portion 34 is projected inward so as to face the first contact portion 33. Retaining protrusions 35 and 35 are formed in edge portions on both sides of a base portion of the press-in portion 32.

Figure 9A:
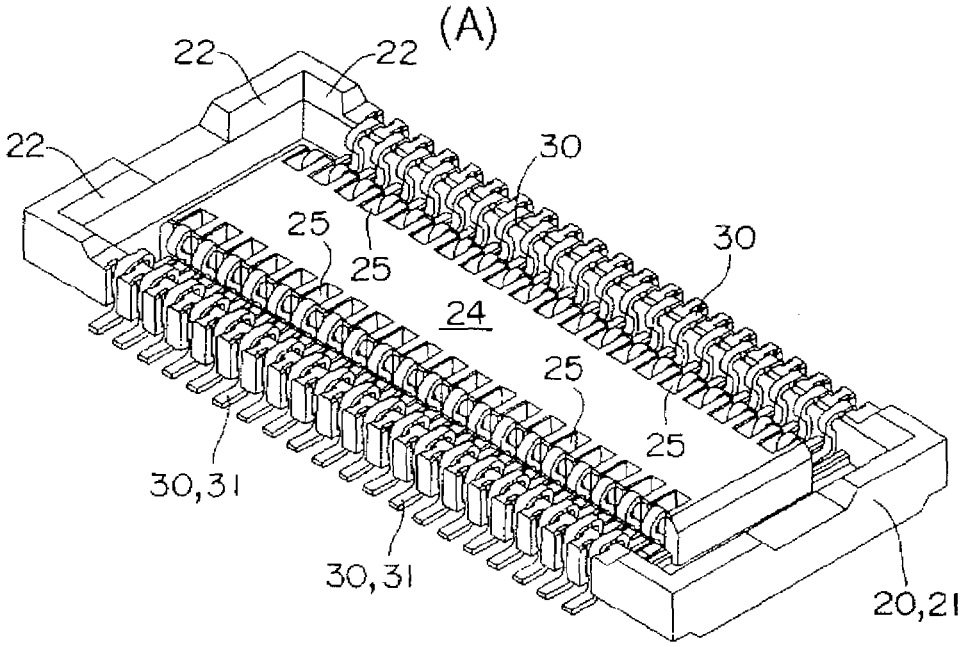
FIGS. 9A and 9B show a perspective view and a partially enlarged plan view illustrating a state in which the first splice is fitted in the socket body.
Figure 9B:
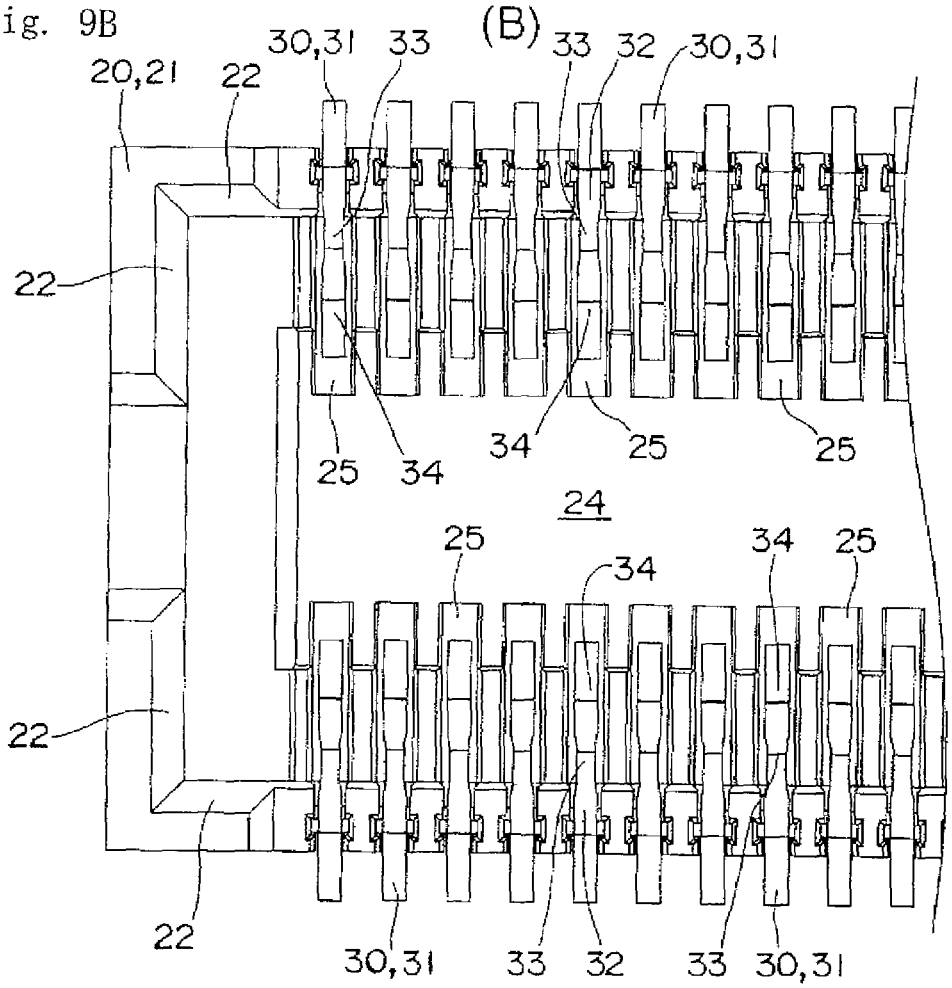

The press-in portion 32 of the first splice 30 is press-fitted in the press-in groove 23 of the socket body 21, whereby the retaining protrusions 35 are latched onto inner side surfaces of the press-in groove 23 to prevent coming off of the first splice 30 (FIG. 9). Because the second contact portion 34 of the first splice 30 is in a loosened state in the fitting groove 25 of the socket body 21, the free end portion of the first splice 30 can elastically be deformed, and can also be rotated by a minute angle. Therefore, even if the component accuracy and assembly accuracy are low of the plug 40, the position can be adjusted by the elastic deformation of the first splice 30. Consequently, according to the present embodiment, the higher component accuracy and assembly accuracy are not required of the socket and plug, which facilitates the production and improve an yield.

The first splice 30 is not limited to the above-described embodiment. For example, as shown in FIG. 8, the corner portion of the press-in portion 32 may be formed in a guiding tapered surface 36 (or R-surface) to facilitate the fitting work.

Figure 10A:
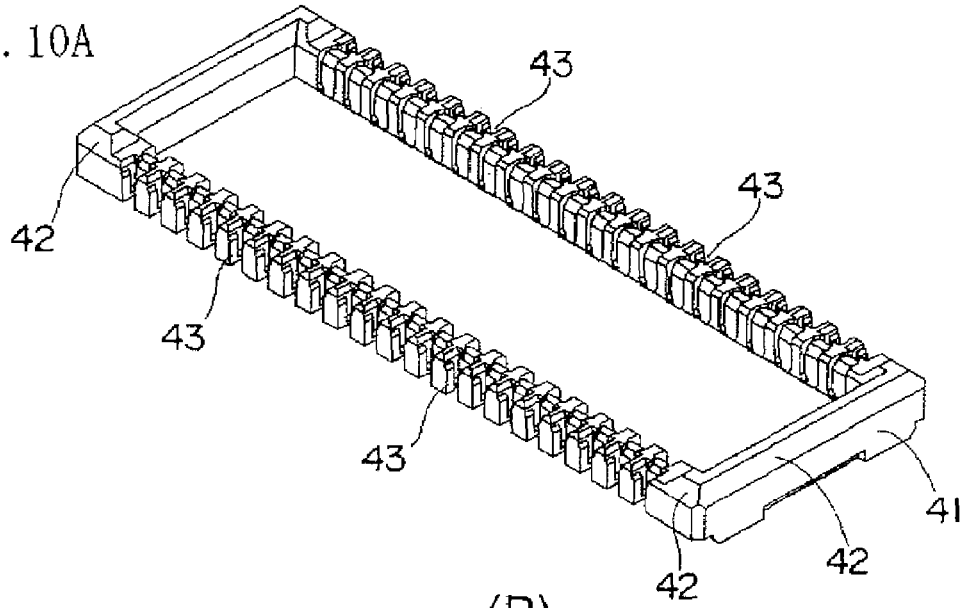
FIGS. 10A and 10B show a perspective view and a partially enlarged plan view of a plug body shown in FIG. 5.
Figure 10B:
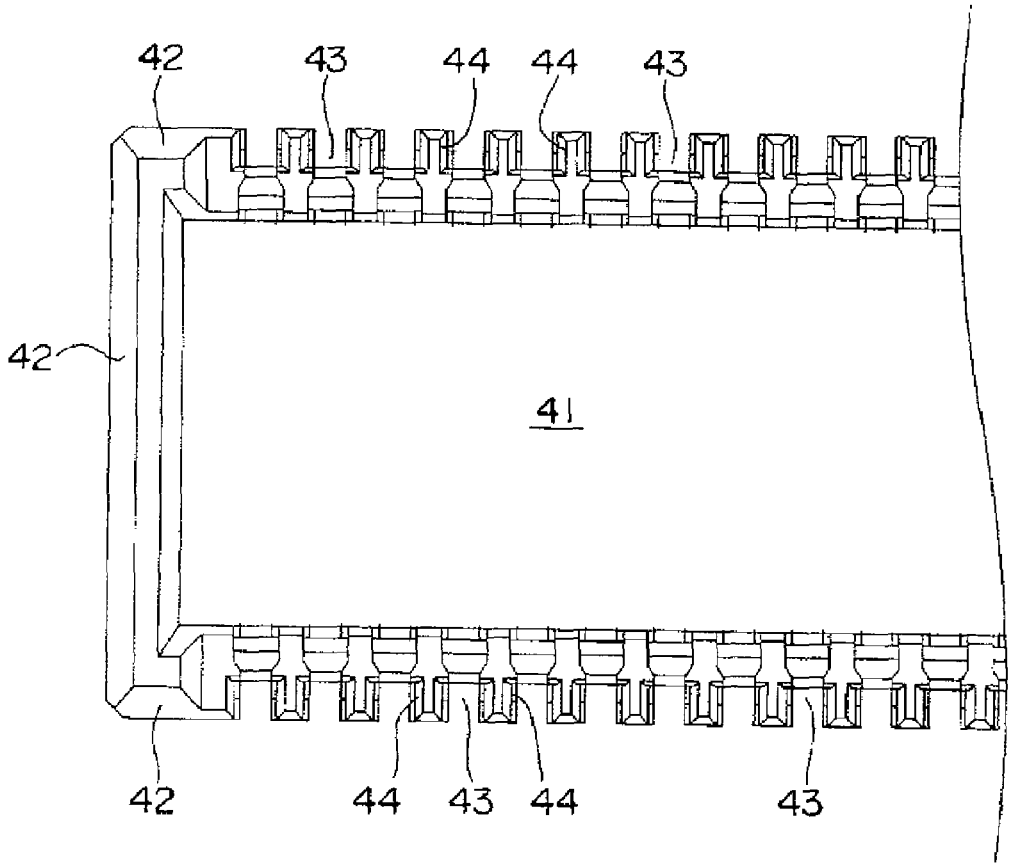
Figure 11A:
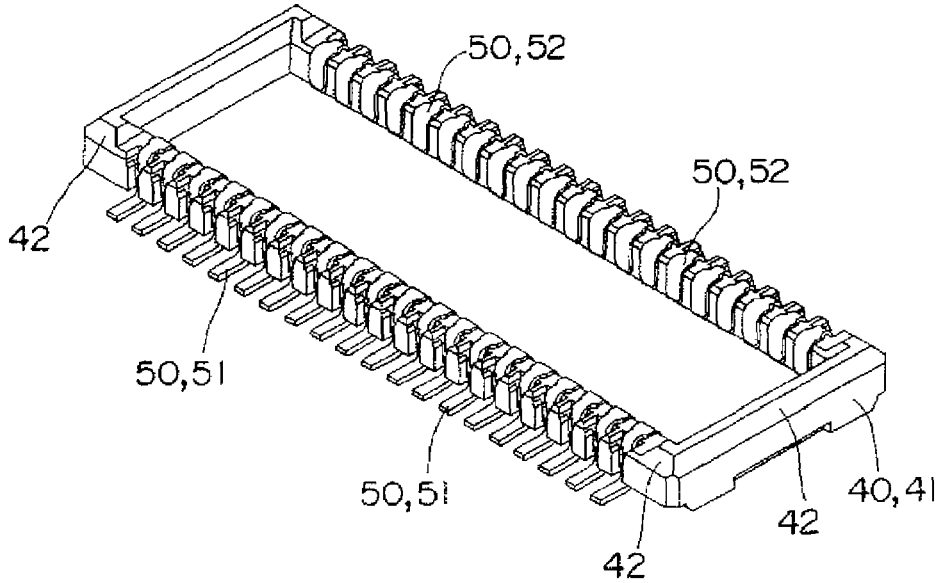
FIGS. 11A and 11B show a perspective view and a partially enlarged plan view illustrating a state in which a second splice is fitted in the plug body.

As shown in FIG. 11, in the plug 40, a plurality of second splices 50 are provided in parallel along opening edge portions located on opposite sides of a plug body 41. Particularly, as shown in FIG. 10, the plug body 41 has a box shape with a flat shallow bottom, and the plug body 41 can be fitted in the socket body 21. A guiding tapered surface 42 is formed in the outer peripheral surface edge portion of the plug body 41, and press-in grooves 43 are provided in parallel at a predetermined pitch along inside and outside surfaces of sidewalls located on opposite sides. The second splices 50 to be described later can be press-fitted in the press-in grooves 43. Particularly, guiding notches 44 are formed in lower edge portions of the press-in grooves 43 (FIGS. 10, 12A, 12B, and 13B).

Figure 5:
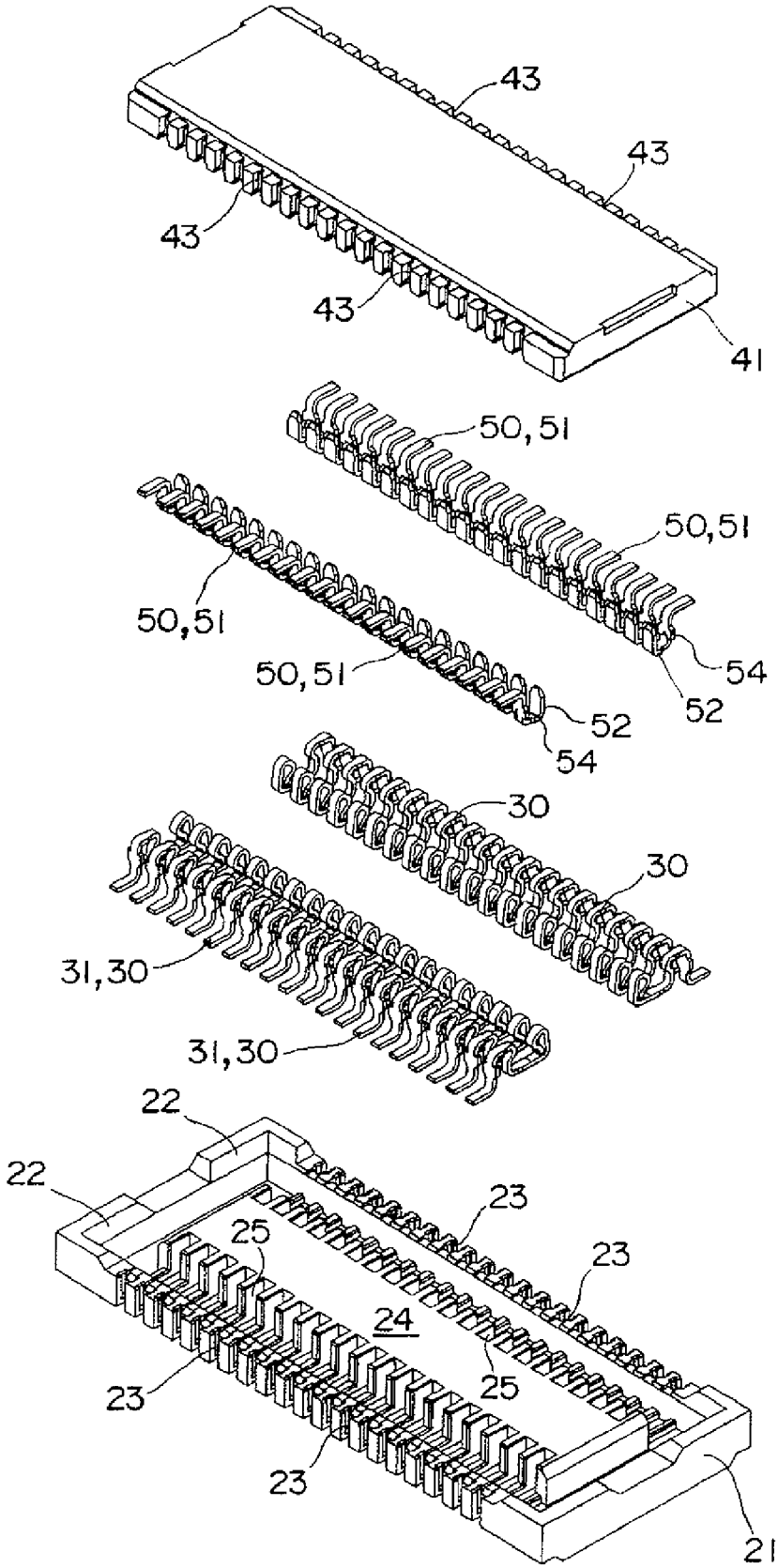
FIG. 5 shows an exploded perspective view of components of the connector shown in FIG. 3.
Figure 7A:
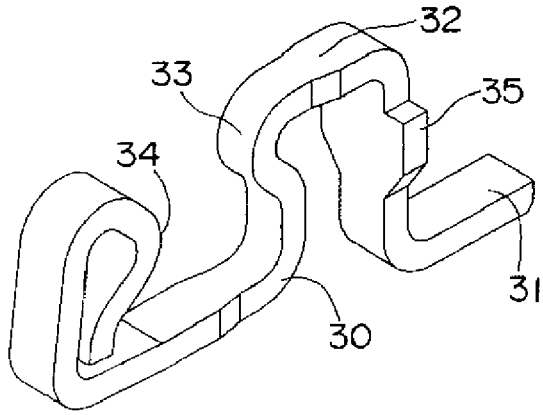
FIGS. 7A to 7D illustrate a first splice shown in FIG. 5, where
Figure 7B:
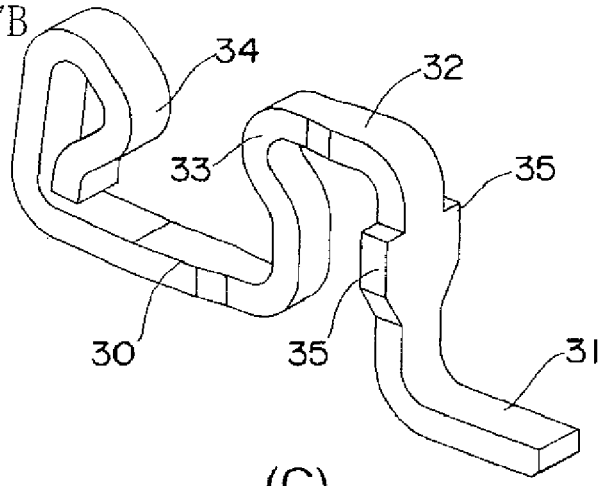
Figure 7C:
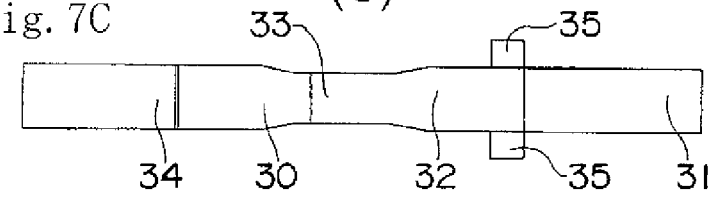
Figure 7D:
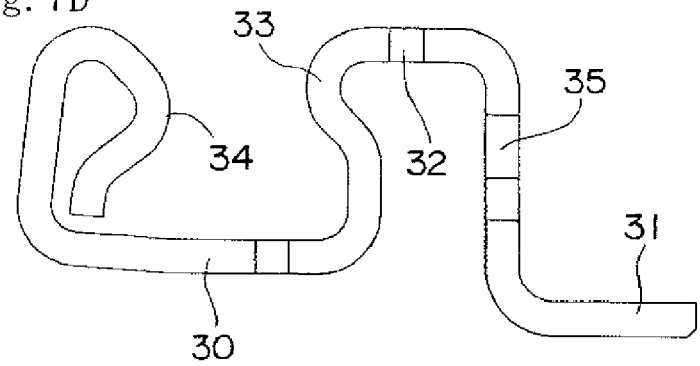
Figure 8A:
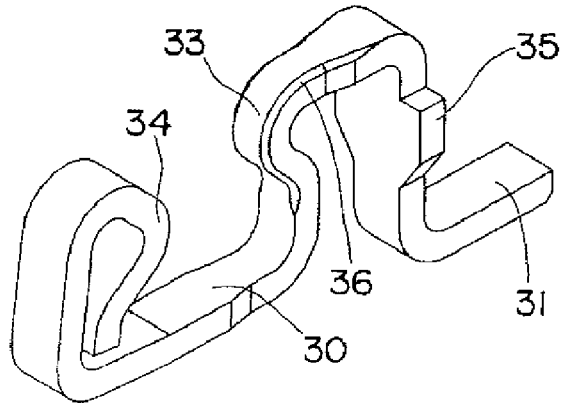
FIGS. 8A to 8D illustrate a modification of the first splice shown in FIG. 7, where
Figure 8B:
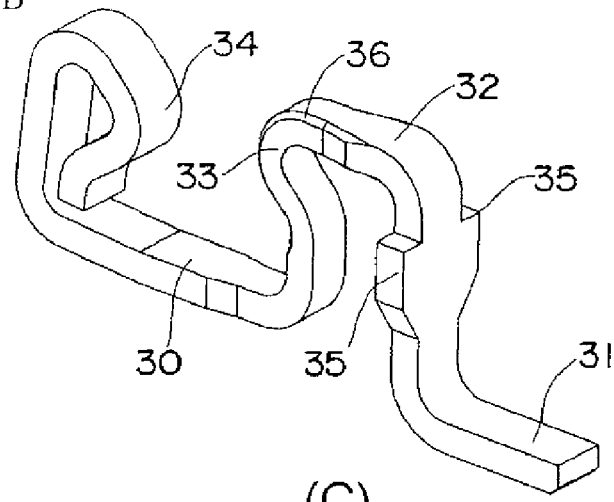
Figure 8C:
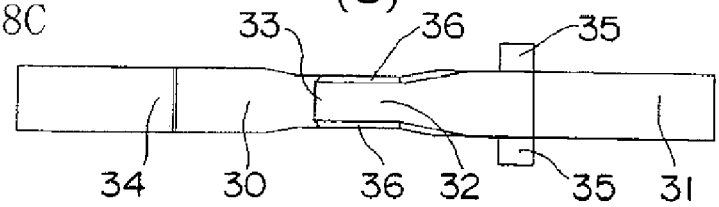
Figure 8D:
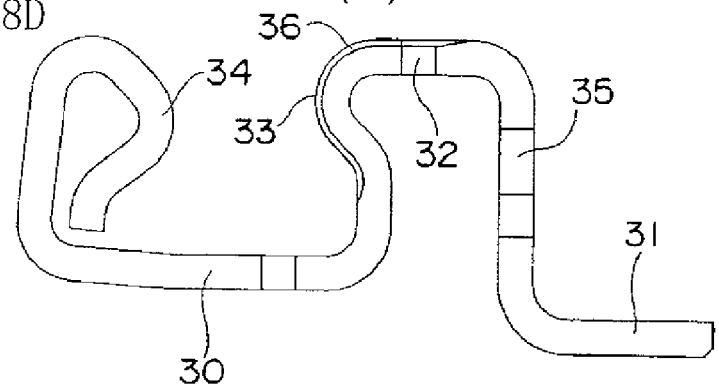
Figure 11B:
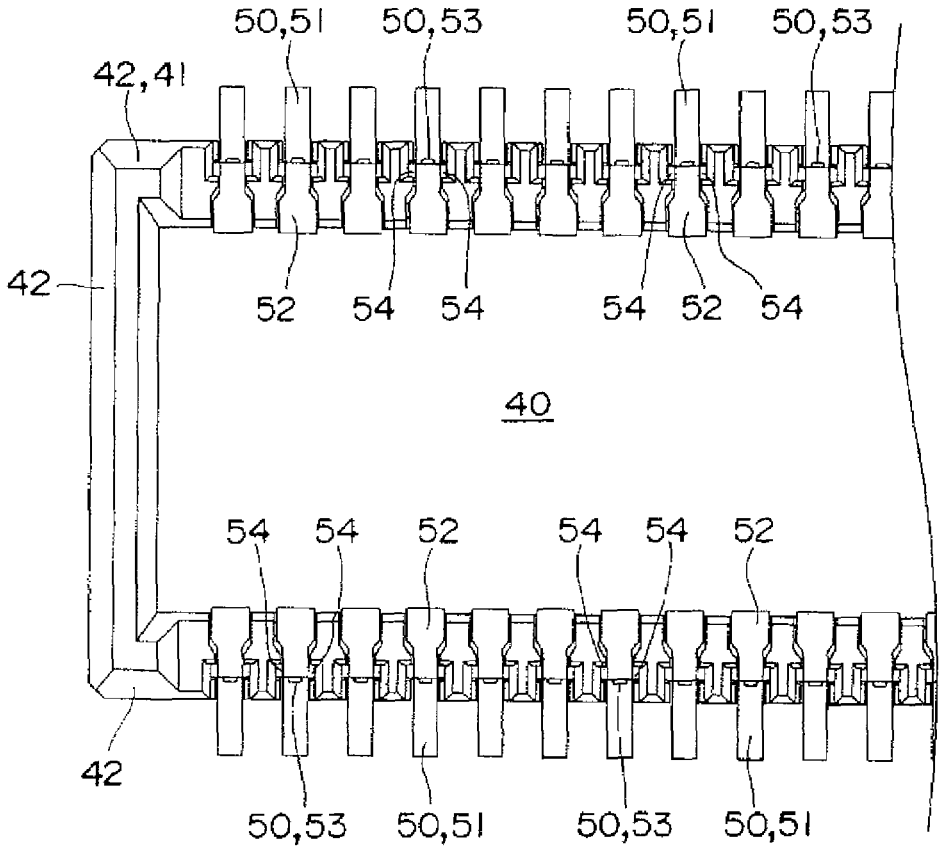
Figures 12A, 12B, 12C:
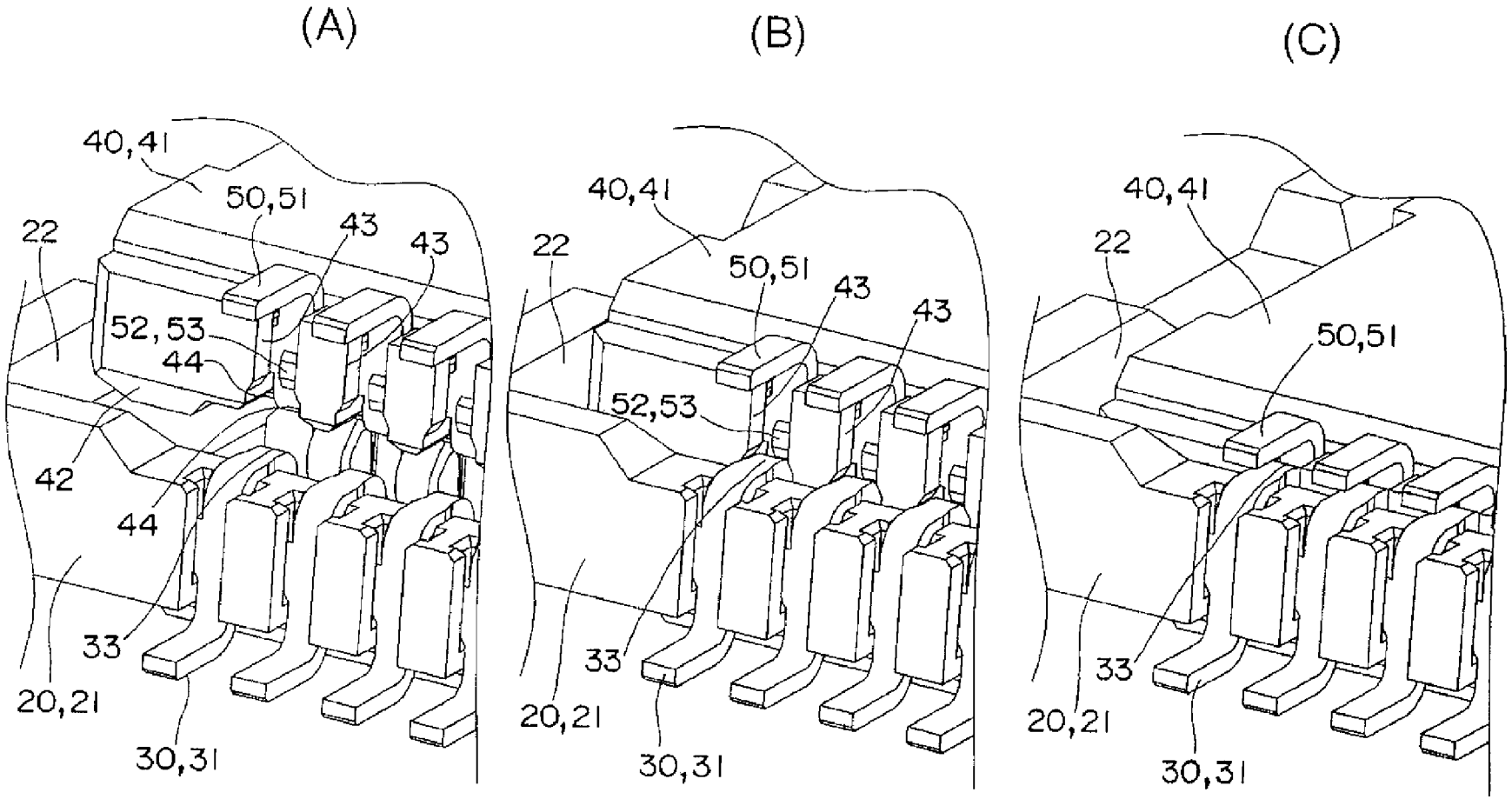
FIGS. 12A to 12C show perspective views for explaining a method of fitting the plug in the socket.

As shown in FIG. 2, the second splice 50 has a substantially U-shaped press-in portion 52 which is extended from a wire connection portion 51 and vertically bent. A click-feeling protrusion 53 is provided by protrusion forming in the outside surface on the side of the wire connection portion 51 of the press-in portion 52 (FIGS. 2, 12A, and 12B), and retaining protrusions 54 are provided on both-side edge portions of the outside surface of the second splice 50 (FIGS. 5 and 11B).

The press-in portion 52 of the second splice 50 is press-fitted in the press-in groove 52 of the plug 40, whereby the retaining protrusions 54 are latched onto the inner side surfaces of the press-in groove 52 to prevent the coming off of the second splice 50.

In the case where the socket 20 and the plug 40 are connected, as shown in FIGS. 1 and 2, the plug 40 attached to the lower surface of a printed wiring board 11 is disposed above the socket 20 attached to the upper surface of a printed wiring board 10. The guiding tapered surface 22 provided in the opening edge portion of the socket body 21 is made to abut on the guiding tapered surface 42 provided in the outer peripheral edge portion of the plug body 41, which allows the positioning to be roughly effected. When the plug 40 is lowered, the first contact portion 33 located at the corner portion of the first splice 30 abuts on the guiding notches 44 provided in the press-in groove 43 of the plug 40, and the first contact portion 33 is guided by the guiding notches 44. Therefore, the plug 40 can be positioned more accurately with respect to the socket 20. Then, the press-in portion 52 of the second splice 50 is brought into elastic contact with the first contact portion 33 and second contact portion 34 of the first splice 30 by pushing in the plug 40, and electric conduction is established between the press-in portion 52 and the first contact portion 33 and second contact portion 34.

Figure 13A:
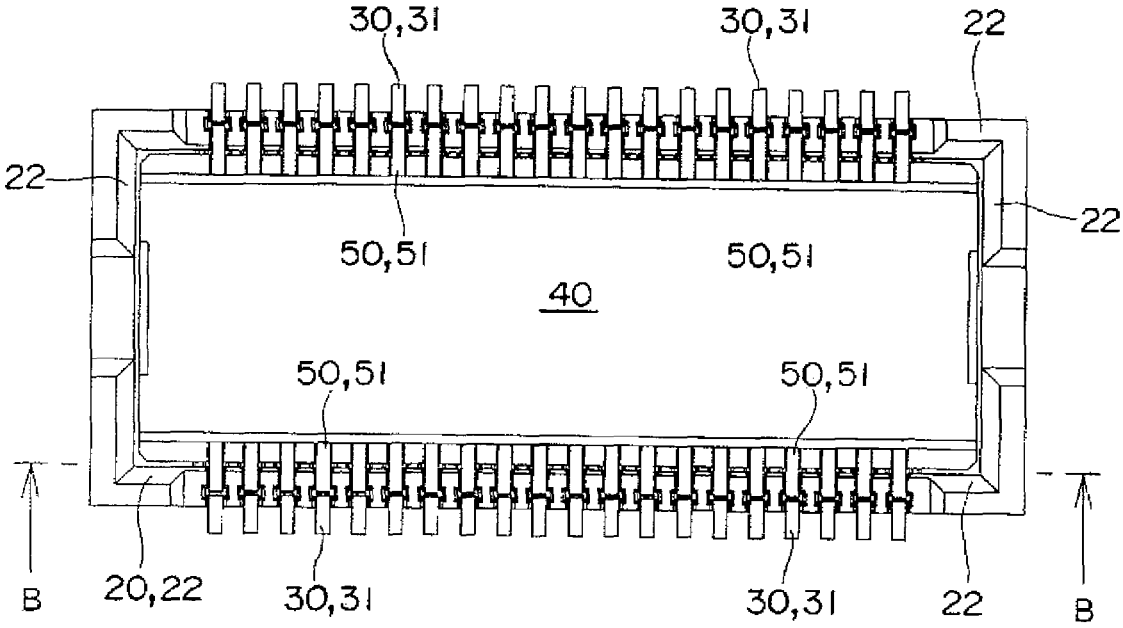
FIG. 13A shows a plan view of the connector illustrating an assembled state.
Figure 13B:
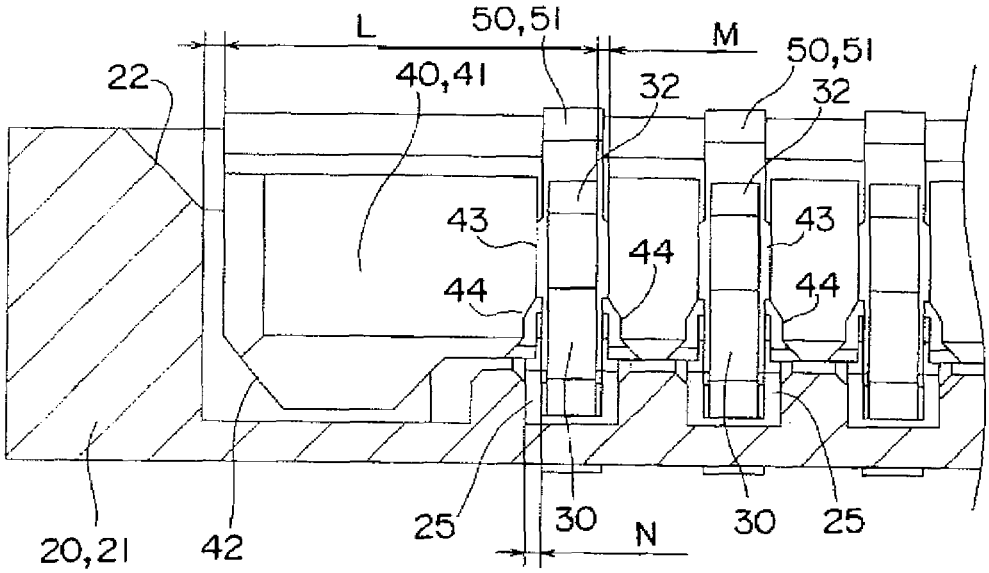
FIG. 13B shows a cross-sectional view taken along a line B-B of FIG. 13A.
Figure 14A:
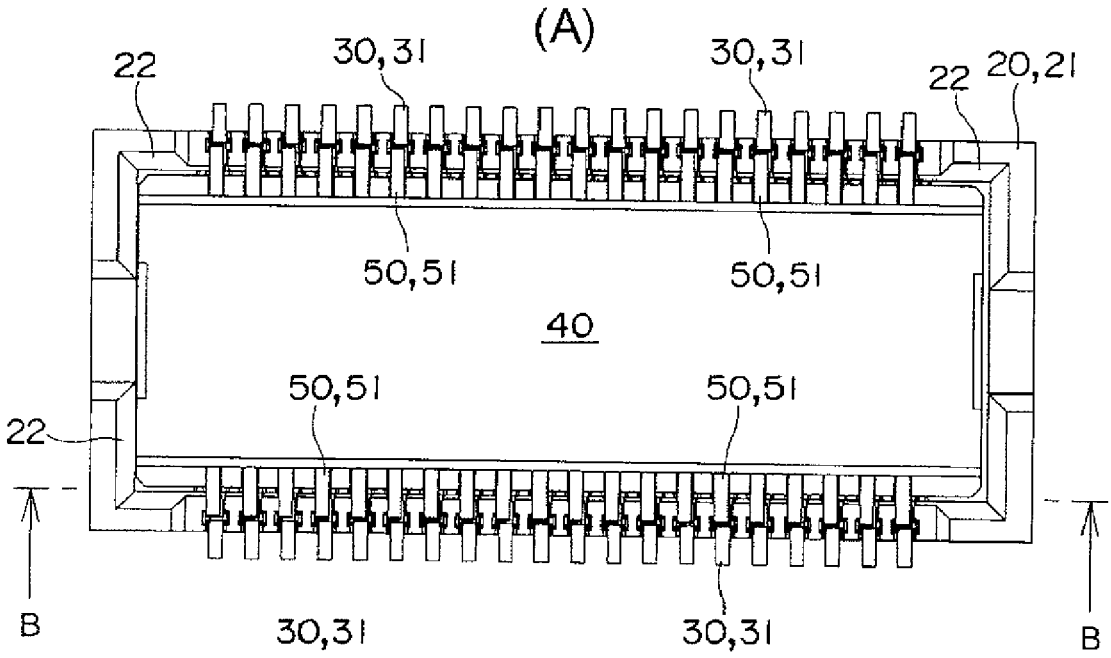
FIG. 14A shows a plan view of the connector illustrating a different assembled state.
Figure 14B:
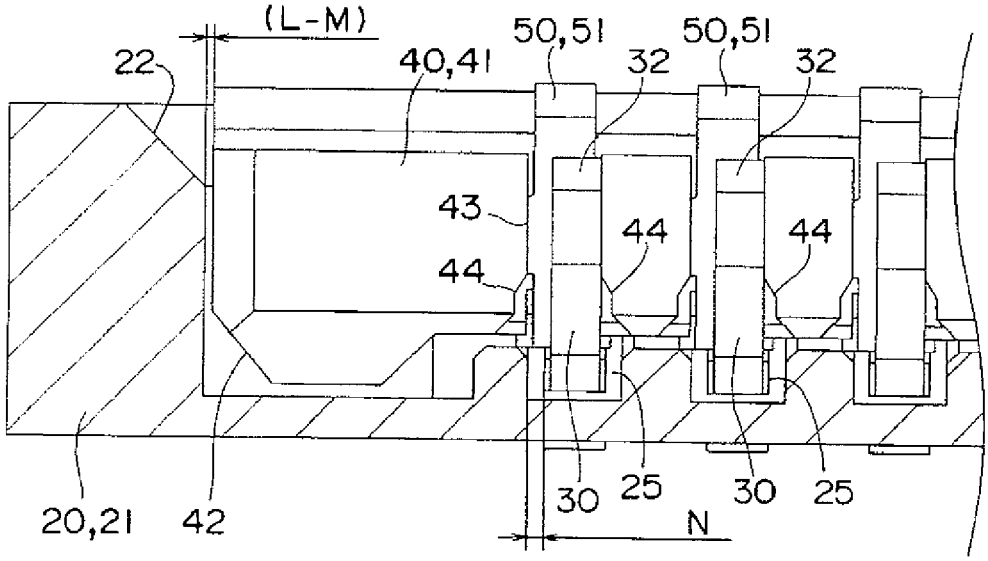
FIG. 14B shows a cross-sectional view taken along a line B-B of FIG. 14A.

According to the present embodiment, as shown in FIG. 13, usually a gap L is generated when the plug 40 is fitted in the socket 20, and a gap M is generated between the first splice 30 fitted in the socket 20 and one side of the press-in groove 43 provided in the plug 40. A relationship of L>M holds. Therefore, even when the plug 40 is shifted by M relative to the socket 20 as shown in FIG. 14, namely, even when the first splice 30 abuts on the inside surface of the press-in groove 43, the plug 40 can be connected to the socket 20 without colliding with the socket 20. Furthermore, the press-in portion 32 of the first splice 30 is press-fitted in the press-in groove 23 provided on the sidewall of the socket body 21, and the free end portion where the first contact portion 34 of the first splice 30 is located can elastically be deformed, so that the first contact portion 34 can be displaced within the fitting groove 25 and brought into elastic contact with the second splice 50. Accordingly, the present embodiment has an advantage that the plug 40 can easily and correctly be connected to the socket 20 even when there are variations in the component accuracy and the assembly accuracy.

According to the present embodiment, because the press-in portion 52 including the click-feeling protrusion 53 is press-fitted between the first and second contact portions 33 and 34, the coming off can be prevented, and the click feeling with which the contact state can be confirmed physically is obtained to give a sense of reassurance to a worker. Additionally, as shown in FIG. 2, because the second contact portion 34 of the first splice 30 outwardly biases the press-in portion 52 of the second splice 50, there is also an advantage that the press-in portion 52 is brought into stronger contact with the first contact portion 33, so that contact reliability can be improved.

The connector of the present invention is not limited to the case in which the printed wiring boards are connected to each other, but the connector can be applied to the connections of other electric instruments.

What is claimed is:

1. A connector comprising:

a socket in which a plurality of first splices are provided in parallel in an opening edge portion;

a plug which has a flat shape capable of being fitted in the opening edge portion of the socket, and a plurality of second splices being press-fitted in press-in grooves provided in parallel at positions corresponding to the first splices in the socket; and guiding notches formed at lower edge portions of each of the press-in grooves, wherein the press-in grooves are provided in parallel at a predetermined pitch along inside and outside surfaces of sidewalls of the plug located on opposite sides, wherein each of the first splices is formed to stride over the opening edge portion of the socket, wherein when the plurality of first splices are fitted, each of the first splices is guided by the guiding notches and an inside surface of each of the press-in grooves, and wherein each of the first splices is brought into elastic contact with one of the second splices to establish an electrical connection.

2. The connector according to claim 1, wherein a second contact portion provided in a free end portion of each of the first splices is brought into elastic contact with a rear surface of a U-shaped press-in portion of one of the second splices press-fitted in one of the press-in grooves of the plug.

3. The connector according to claim 2, wherein:

retaining protrusions are provided on both outside surfaces of the U-shaped press-in portion of each of the second splices;

the retaining protrusions are latched onto at least one of a first contact portion and the second contact portion of each of the first splices;

each of the second splices are press-fitted between the first contact portion and the second contact portion of one of the first splices; and the first contact portion and the second contact portion of each of the first splices oppose each other.

4. The connector according to claim 1, wherein each of the first splices comprises a first contact portion provided so as to project at a corner portion inside a press-in portion of one of the first splices press-fitted and retained in the opening edge portion, wherein when the plurality of first splices are fitted, each of the first contact portions is guided by an inside surface of each of the press-in grooves, and wherein each of the first contact portions is brought into elastic contact with one of the second splices to establish an electrical connection.

* * * * *